United States Patent [19]

Richter

[11] 4,385,873

[45] May 31, 1983

[54] ROTARY VANE TYPE PUMP OR MOTOR AND THE LIKE WITH CIRCULAR CHAMBER PORTIONS

[76] Inventor: Hans H. Richter, 258W. Shore Rd., Warwick, R.I. 02889

[21] Appl. No.: 194,805

[22] Filed: Oct. 7, 1980

[51] Int. Cl.[3] ..... F01C 1/00; F01C 21/10; F01C 21/16

[52] U.S. Cl. ..... 418/23; 418/255; 418/257

[58] Field of Search ..... 418/23, 254, 255, 257

[56] References Cited

U.S. PATENT DOCUMENTS

| | | | |
|---|---|---|---|
| 825,671 | 7/1906 | Machlet | 418/255 |
| 870,293 | 11/1907 | Hewey | 418/255 |
| 1,444,269 | 2/1923 | Piatt | 418/257 |
| 1,626,510 | 4/1927 | Chase | 418/255 |
| 2,452,471 | 10/1948 | Jones | 418/255 |
| 2,498,826 | 2/1950 | Ruona | 418/23 |
| 2,585,406 | 2/1952 | Reynolds | 418/255 |
| 2,684,771 | 7/1954 | Ehrenhaft | 418/23 |

FOREIGN PATENT DOCUMENTS

| | | | |
|---|---|---|---|
| 531659 | 10/1921 | France | 418/255 |
| 24330 | 2/1922 | France | 418/257 |
| 285874 | 2/1928 | United Kingdom | 418/255 |
| 739725 | 11/1955 | United Kingdom | 418/255 |

*Primary Examiner*—John J. Vrablik

*Attorney, Agent, or Firm*—Bailey & Hardaway

[57] ABSTRACT

A rotary vane type motor, compressor or pump in which an eccentrically mounted rotor having sliding vanes rotates within a stationary main housing or stator. The stator is in turn defined by a pair of opposed shells, each shell essentially being a half cylinder such that the internal working surface of the stator against which the vanes move, forms essentially two opposed and identical circular paths or segments. The movement path of the vanes may be further controlled by rollers affixed thereto and adapted to engage a free idling race ring mounted inside of the hollow rotor and supported by means of a stationary crankshaft. In this added way the vanes pass the internal working surface of the stator without contact at a controlled clearance and the centrifugal force of the vanes acting against the stator housing is eliminated such that increased efficiency and operation at substantially higher speeds is accomplished.

3 Claims, 11 Drawing Figures

ROTARY VANE TYPE PUMP OR MOTOR AND THE LIKE WITH CIRCULAR CHAMBER PORTIONS

BACKGROUND AND SUMMARY OF THE INVENTION

This invention relates to a vane type motor, compressor or pump of the type in which a fluid medium such as liquid or gas is either acted upon or utilized as the drive mechanism for producing useful work. Thus when utilized as a pump, rotary motion is imparted to the impeller such that the vanes force liquid or gas located within the stator chamber to a point remote thereof. Similarly when used as a compressor, the vanes operate to compress a gaseous fluid similarly present in the stator chamber. Also when operated as a motor, a temperature and/or pressure elevated gaseous medium; for instance, steam, may be directed into the stator chamber so as to cause rotation of the rotor by reason of force exerted upon the vanes from which rotary motion may be usefully directed via a power takeoff associated with the rotor. Obviously, steam in such a situation would be condensed and could be utilized in a closed recycling system. The use of the device as a motor, of course, is not however limited to steam or other condensable fluids but can be operated on pressure differentials unrelated to temperature differences. Also the source of temperature differential when utilized may be from any source including solar energy.

Motors, compressors, or pumps of the above general type construction are well known and include those in which vanes are guided for slidable motion within slots provided in an eccentrically displaced rotor such as shown in FIGS. 6 and 7 of the present drawings. Such vane constructions are representative of the prior art and include disposition in recesses disposed radially; i.e., vertical, to the rotor cylinder such as shown in FIG. 6 wherein the centrifugal force developed by the vanes rotating within the rotor will act against and be supported primiarily by the rotor housing and results in a necessarily high frictional force. This force can be to an extent reduced by a tangential disposition of the vane slots such as shown in FIG. 7. The FIG. 7 arrangement reduces centrifugal force of the vanes against the rotor housing but simultaneously increases the torque of the vanes against the rotor slots and this torque or tilting forces the vanes against the slot walls and thus undesirably causes wear at the interface.

Because of these above-indicated disadvantages, it has been proposed to form a slidable double vane unit such as that shown in U.S. Pat. Nos. 2,314,056; and 2,347,944. In such constructions, however, due to the need of the eccentric displacement of the rotor with regard to the stator housing, the housing must be shaped not in the form of a true circular cylinder but in the form of a generated curve formed in accordance with a complex formula and which necessitates expensive and special machining of the stator housing. An example of such type construction is best shown in U.S. Pat. No. 2,347,944 issued May 2, 1944 in which only relatively minor sections of the rotor housing is formed in a true circular path. Although such constructions are expensive and complex to produce, they do substantially reduce the frictional force at which the vanes contact the rotor housing.

Other ways of increasing the efficiency of such devices by reducing frictional contact of the vanes against the rotor housing have been proposed such as supporting the vanes by means of rollers attached thereto and guided by stationary inner race tracks attached to the stator walls. Such systems have been proposed with differenct stator configuration; for example, as single-action (FIGS. 6–7) or double-acting pump or motor. The attendant disadvantage on all these systems is, however, that the rollers are required to rotate at a much higher RPM than the rotor, approximately 6 to 12 times faster dependent upon the ratio between the O.D. of the roller and the I.D. of the race track.

Thus although the sliding friction of the vanes against the stator housing is eliminated and transferred into rolling resistance of the roller against the stationary inner race track, the attendant very high revolution of the rollers already by moderate rotation of the rotor (approximately 1000 to 2000 RPM) and the necessary additional rotation of the rollers with the rotor around its axis, presents extreme difficult running conditions which requires either substantial speed reduction (rotor RPM) or bearing life time, and thus not acceptable. Therefore this type of systems is limited in its applicability.

It is accordingly the principal objective of the present invention to provide a motor of the aforementioned sliding vane type which effectively reduces the centrifugal force developed by the rotating vanes and which also prevents any remaining centrifugal force from acting against the stator housing in a new, unique, simple, efficient, and effective manner.

This and other features of the present invention are accomodated by the use of a stator housing including a pair of opposed true circular cylinder halves each of which is shortened by a distance equal to about half the internal diameter of a theoretical true cylinder and the horizontal cylinder chord length at the central axis of the rotor. Further improvement of the operating characteristics of the subject motor are provided by incorporation of rollers or sliding shoes attached to the double vanes which in turn roll or slide against idling race rings mounted inside of the hollow rotor and supported by means of a stationary crankshaft.

Other objects, features and advantages of the invention shall become apparent as the description thereof proceeds when considered in connection with the accompanying illustrative drawings.

DESCRIPTION OF THE INVENTION

Figure 1:
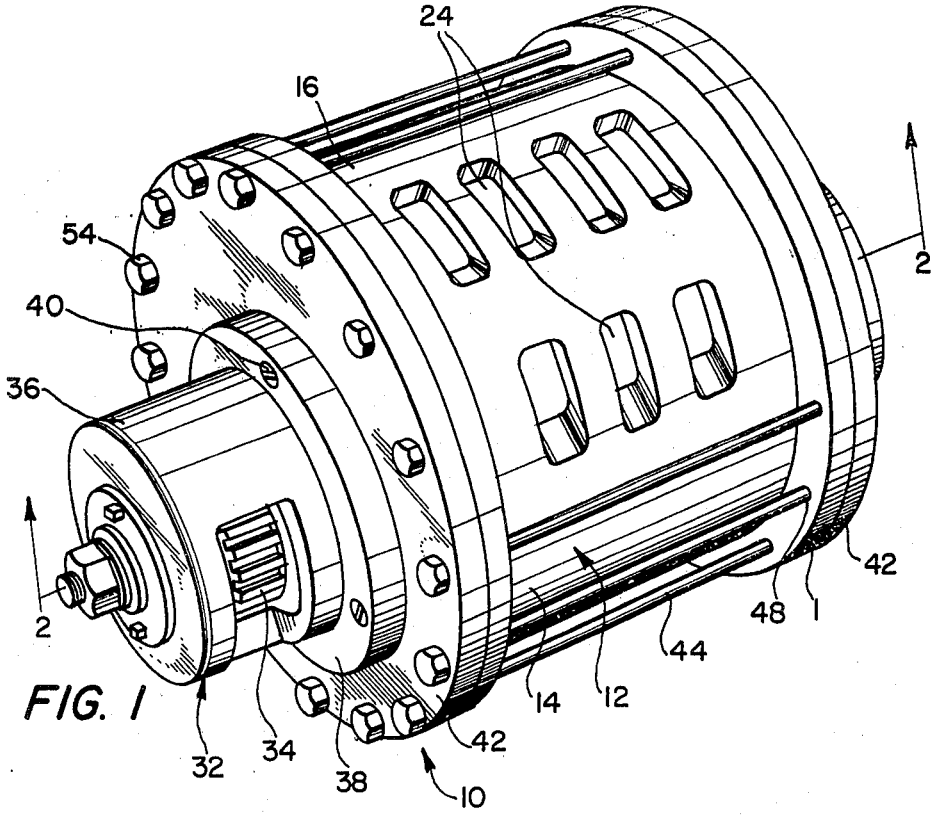
FIG. 1 is a perspective view of the rotary vane type motor device of the present invention wherein inlet and outlet gas ducts have been removed for clarity.

Turning now to the drawings and in particularly FIG. 1 thereof, the overall configuration of the motor, compressor or pump 10 of the present invention is best shown. Also, although previously indicated that such device 10 may equally function as a motor, compressor, or pump dependent on its operational mode, it's operation will hereinafter be described as that of a motor. Accordingly, the term motor as used herein relates also to pumps or compressors dependent on the operational mode of the device 10.

The motor 10 includes a generally cylindrical main housing 12 formed in a manner which hereinafter will be more fully explained. The housing includes a pair of hollow cylindrical shells 14 and 16 which are shortened and rejoined in a manner which also will be fully explained so as to provide a hollow stator for the motor 10. A rotor assembly 18 includes a hollow cylindrical rotor 20 and a vane assembly 22. Gas inlet ports 24 and outlet ports 26 are provided in the housing 12 such that rotary motion may be imparted to rotor 20 and power created thereby harnessed by means of a power takeoff assembly 32 including a driven sprocket 34 over which power belt (not shown) may be trained.

The power takeoff assembly 32 further includes a hollow end cap 36 inwardly terminating in a outwardly extended radial flange 38. The flange 38 is in turn secured by any suitable means such as the bolts 40 shown to a circular end plate 42. There are two such circular end plates provided, one on either side of the cylindrical shells 14 and 16 and serve to position the aforementioned shells in place by means of a plurality of circumferentially spaced tie rods 44 extending through aligned openings 46 and 48 respectively formed through the end plates 42 and radial flanges 50 and 52 respectively provided on the shells 14 and 16. The tie rods 44 are threaded at opposite ends thereof and bolts 54 serve interconnect housing 12 with respect to the plates 42 in the intended manner. It should also be pointed out that in those areas in which the gas inlet and exit openings 24 and 26 are provided in the housing, that the tie rods 44 are omitted and the housing provided with gaseous inlet and outlet ducts 28 and 30. Additionally, the flanges 50 and 52 may be held to the end plates 42 in such gas inlet and outlet areas by means of a plurality of bolts 56.

Figure 3:
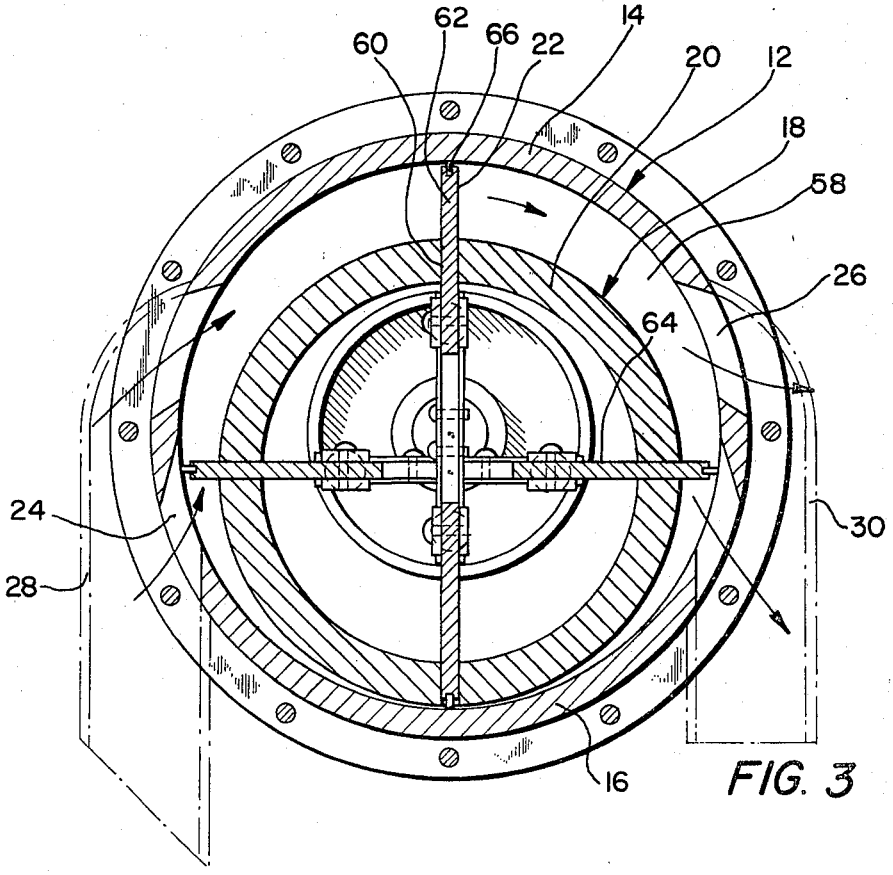
FIG. 3 is a vertical cross-sectional view and shows the relationship of the rotor, vanes, and stator housing when viewed from an end thereof.
Figure 8:
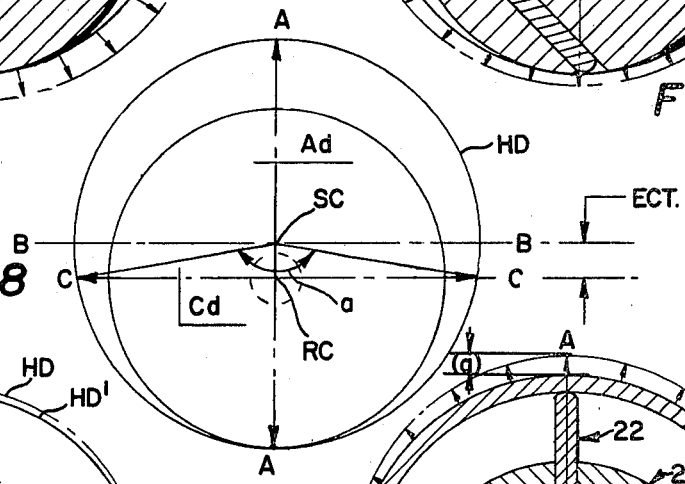
FIG. 8 is also a diagrammatic view illustrating the relationship between the stator housing and rotor axes and illustrating in particular the eccentric displacement of the rotor axis vis-a-vis the stator chamber.

As may best be seen by FIG. 3, the rotor 20 is separately mounted within the housing 12 so as to form a stator chamber 58 between the internal surface of the housing 12 and the external surface of the rotor 20. Accordingly, the rotor 20 is rotatable about its central axis RC as best shown in FIG. 8. The rotor 20 is further provided with two pair of diametrically opposed equally spaced slots 60 and in which the vane assembly 22 is adapted to slide. The vane assembly 22 includes a pair of separate double vanes illustrated at 62 and 64 which are configured so as to enable them to slide with respect to each other as well as radially within the slots 60. The other ends of the vanes 62 and 64 are provided with seals 66 of appropriate construction such that a sliding sealing engagement is made with the stator; that is, the inside surface of the housing 12 in the desired manner. The combined lengths of the vanes 62 and 64 including the seals 66 is greater than the external diameter of the rotor and accordingly the vanes project radially from the rotor such that opposed ends of both of the vanes 62 and 64 pass the internal surface of the stator at any point with a controlled clearance and negligible variations at any point during the rotation of the rotor. Accordingly, the interior of the stator cannot be circular but as described in the aforementioned prior art need be shaped to accomodate the above-described action. The present motor construction affords such desirable non-circular configuration by maintaining an almost circular path in a straightforward, inexpensive, and easily machined manner so as to present significant improved performance characteristics over prior art devices.

The manner in which such is accomplished is best seen by simultaneous reference to FIGS. 3 and 8 through 10. Thus FIG. 8 diagrammatically illustrates the conventional arrangement of a rotor mounted eccentrically within a true cylindrical housing wherein SC is the stator center and RC is the rotor center. The distance A—A thus represents the diameter of the stator and the distance C—C equal to the chord length defined by a horizontal plane passing through the rotor center RC. Accordingly, the distance C—C will always be defined by equation C—C=A—A×sine a/2 and consequently will always be smaller than the line A—A and is dependent on the value of the eccentric displacement of the rotor with respect to the stator identified as ECT.

Figure 6:
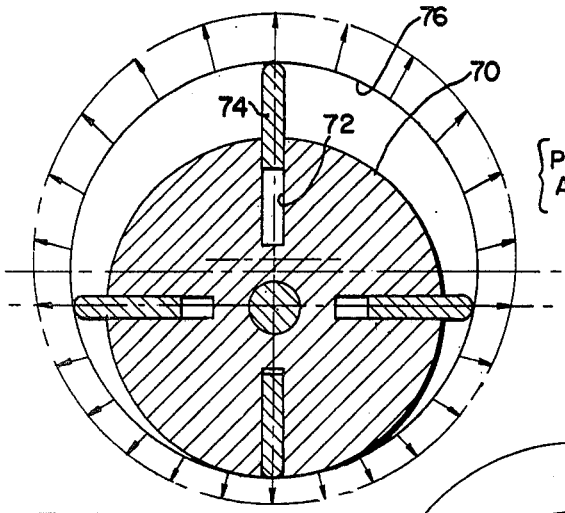
FIG. 6 PRIOR ART
FIGS. 6 and 7 are diagrammatic illustrations of the centrifugal force distribution created by the interaction between the vanes and stator housing of known i.e. "prior art" constructions.
Figure 7:
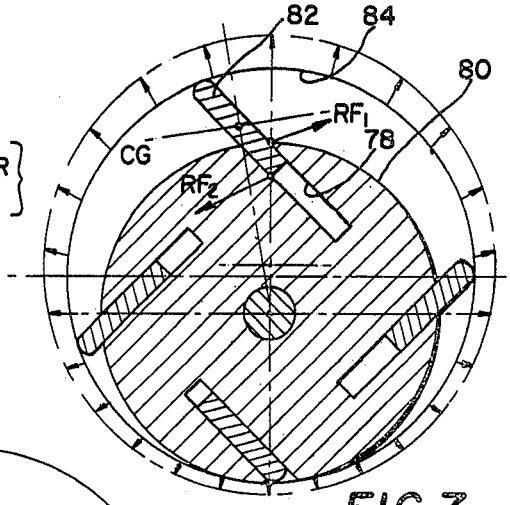
Figure 9:
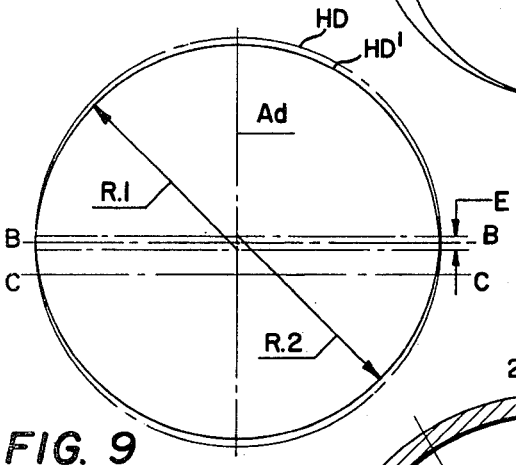
FIG. 9 is a diagrammatic view illustrating the manner in which the stator housing of the present invention is constructed from two true cylindrical shells or halves.
Figure 10:
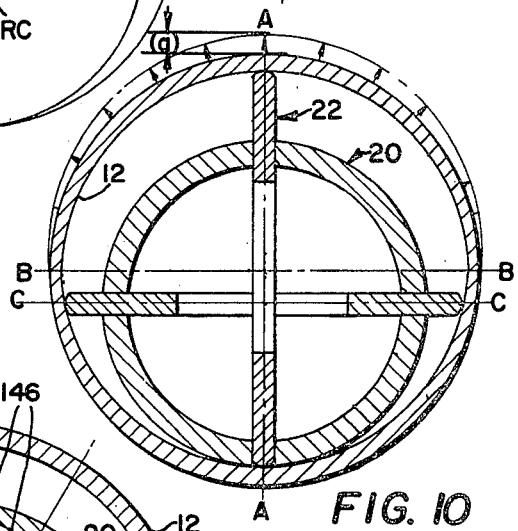
FIG. 10 is a diagrammatic view illustrating a substantial reduction in centrifugal force brought about by the stator housing construction illustrated.

The cylindrical housing HD as shown in FIG. 8 is divided into cylinder halves along the cylinder center line B—B. By removing a portion of the resulting open ends of such cylinder halves an amount equal to the length difference E between the distance A—A and C—C and then rejoining the halves, the resultant housing represented by the solid line HD' in FIG. 9 is formed. In FIG. 9, R.1 and R.2 are equal and represent the true diameter Ad. Rotation of the vane assembly 22 within housing HD around the rotor center RC results in only negligible deviation of approximately 0.5% of the length of either vanes 62 or 64 when in contact with the stator surface. Furthermore and as best illustrated by FIG. 10 such relationship results in a substantial reduction of the centrifugal force in comparison with prior art construction such as represented by FIGS. 6 and 7 inasmuch as the vanes 62 and 64 press against the stator housing substantially only in the pressurized operating zone of the stator chamber 58; that is, the upper arcuate portion of the stator chamber primarily located between gas inlet and outlet openings 24 and 26 and approximately of a 150 degree arcuate extent. In FIG. 10, "a" represents the value and direction of the centrifugal force. Such FIG. 10 area of frictional force or wasted energy is represented by the outlined area in which the vector force arrows are positioned and is of a substantially smaller value than those in FIGS. 6 and 7. In that regard, FIGS. 6 and 7 show existing and widely used vane arrangements wherein a rotor rotates within a true circular cylinder.

As shown in FIG. 6 such rotor is provided with a plurality of radially extending slots 72 in which separate vanes 74 are positioned. The vanes 74 are spring urged into engagement with the inside diameter of the stator 76, the outlined area between the dotted circular line and the outside of the stator 76 representing the direction and value of the resultant centrifugal force. Turning now to FIG. 7, the configuration of the slots 78 in a rotor 80 has been modified such that the slots are formed along chordal paths. Vanes 82 are similarly positioned in such slots 78 and spring urged outwardly against the inside surface of the stator 84. Such arrangement results in the vanes 82 being disposed tangential to the rotor 80. Such arrangement results in a reduced centrifugal force CF over that present in the FIG. 6 construction but one in which the center point of gravity CG is displaced and develops resulting force components RF1 and RF2 which produce a torque between the vanes 82 and the slots 78. Although this arrangement results in a material reduction in the total centrifugal force produced by the vanes 82 acting upon the stator walls 84 the resultant force causes an undesirable frictional engagement and wear between the vanes and the walls defining the slot walls 78. It may be thus apparent that the stator configuration of the motor 10 of the subject invention desirably reduces not only the centrifugal force present between the vanes and stator housing but additionally accomplishes such without undesirable side effects such as the undesirable slot wear possible in the FIG. 7 construction.

Figure 2:
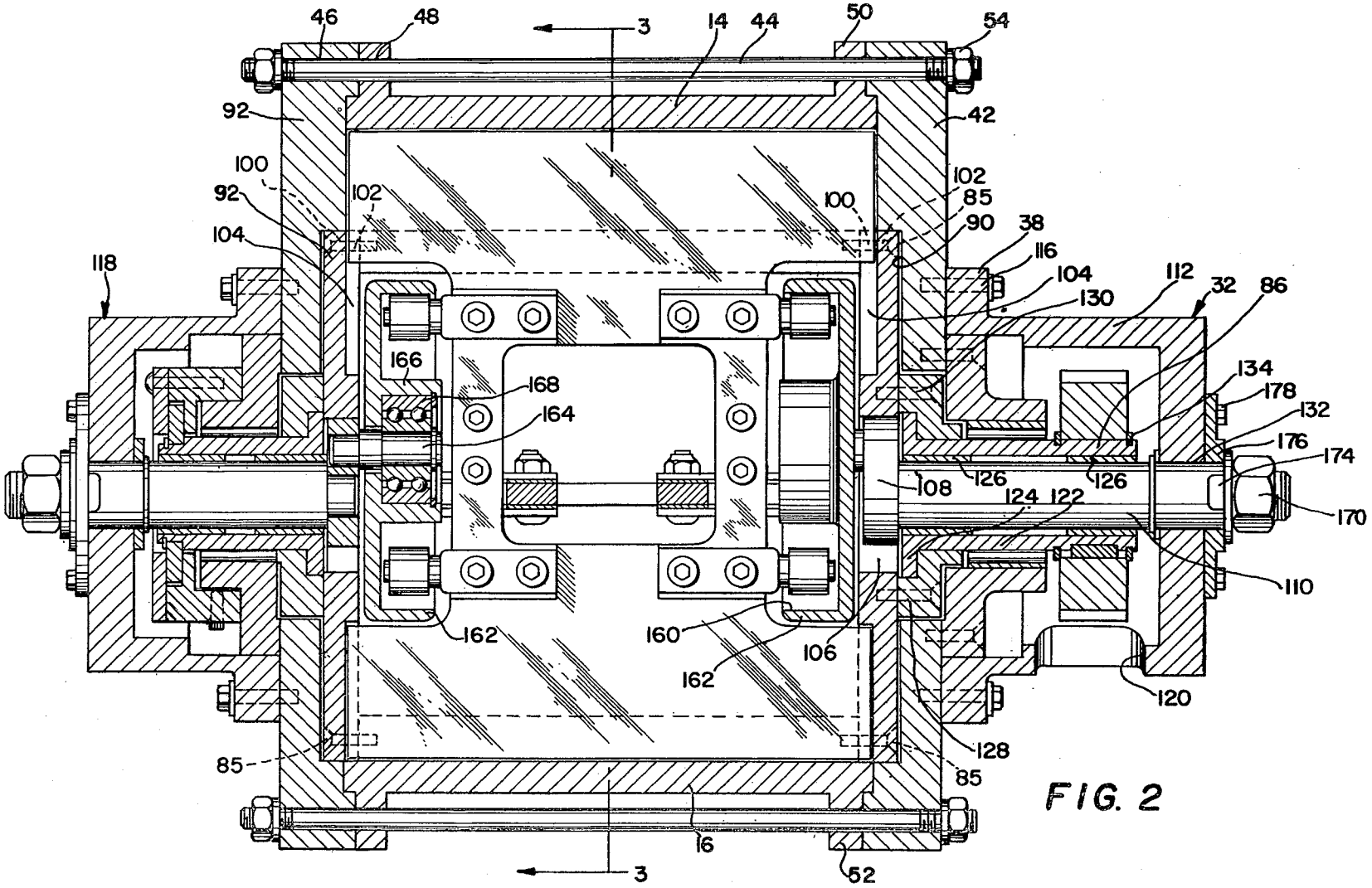
FIG. 2 is a cross-sectional elevational view taken parallel to the cylinder and rotor axis along line 2—2 of FIG. 1 and shows in particular the internal construction of the stator and rotor assemblies.

Turning again to the drawings, and FIG. 2 in particular, the manner in which the desirable stator configuration is brought about and assembled within the motor configuration 10 of the present invention is best shown. Also depicted is a means by which the motion of the vane assembly 22 is controlled with respect to the stator surface in such a way so as to prevent any action of the frictional forces produced by the vanes against the stator housing. This additional improvement will be apparent as the description of the invention proceeds and is graphically of diagrammatically illustrated by FIG. 11 as well.

Figure 4:
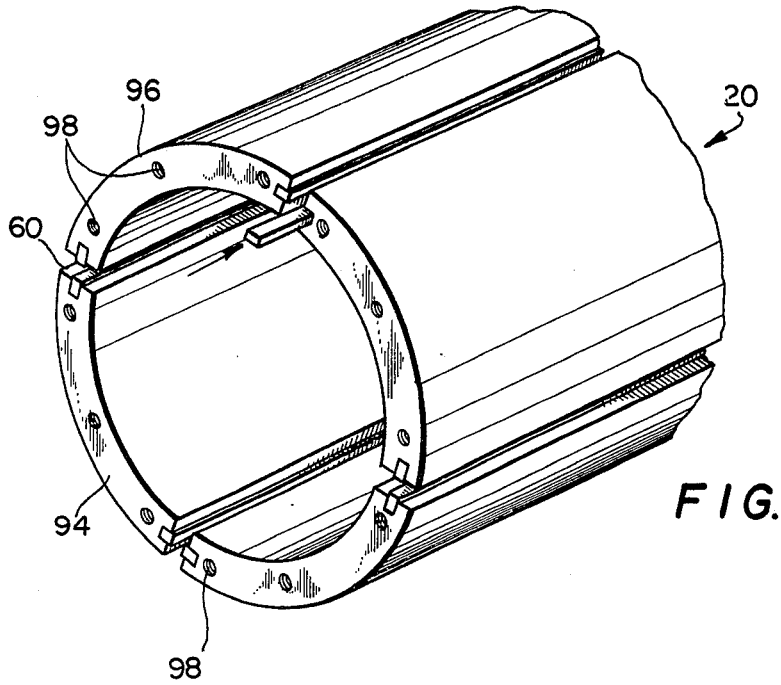
FIG. 4 is a perspective view of the rotor assembly.

Any suitable means is utilized to seal the shortened cylindrical segments 14 and 16 together at their parting line B—B and may include a gasket or other sealant material. As previously explained, the housing segments 14 and 16 are positioned together by means of the tie bars 44 as well as the bolts 56. Additionally, each of the end plates 42 is provided with an eccentric recess 90 into which the circular end caps 92 of the rotor 20 are adapted to extend. In this regard and as best shown in FIG. 4, the rotor 20 includes four individual segments 94 which are held together and in spaced relationship to each other so as to form the slots 60 by means of such end caps 92. The opposite edge faces 96 of each such segment 94 are provided with tapped or threaded holes 98 which are adapted to receive bolts 100 passing through aligned openings 102 in the end caps 92. Each of the end caps 92 is further provided with four equal radially extending recesses 104 into which the outer edges of vanes 62 and 64 are adapted to extend in a manner that will hereinafter be more clearly explained. Additionally, each end cap 92 is also provided with a central circular recess 106 in which a disc shaped crank 108 of a rotor support shaft 110 is positioned.

The power takeoff assembly 32 includes a bearing cover 112 which at its open end terminates in the outwardly extending flange 38 through which it is bolted to the end plate 42 by the bolts 116. A similar bearing cap 118 is positioned on the end plate 42 position to the left of the housing as shown in FIG. 2. The difference between the bearing caps 112 and 118 being that the power takeoff cap 112 is provided an opening 120 through which the driven gear 32 may be suitably connected to a power takeoff belt (not shown). A hollow shaft 122 having a radial flange 124 at its inner end is positioned and supported by the shaft 110 by means of roller bearings 126. A circular collar 128 serves to engage the flange 124 and thereby attach the shaft 122 to the rotor end cap via a plurality of bolts 130. The opposite ends of each of the rotor shafts 110 are supported within openings 132 provided in the end caps 112 and 118 is rotatably supported by bearings positioned on the fixed positioned rotor shafts 110. In this manner, the rotor 20 is free to rotate within the stator chamber within the suitable clearance provided by the recess 90 in each of the end plates 42. The driven gear 34 is fixed to the outer surface of the hollow shaft 122 by means of retaining rings 134. It should be noted that the shaft 122 in the power takeoff side; that is, within the bearing cap 112, is longer than that positioned on the opposite side within bearing cap 118 so as to accomodate the driven gear 34.

Introducing a pressurized gaseous medium into the stator chamber causes the vanes 62 and 64 to move which in turn imparts a rotary motion to the rotor. Such gaseous medium is introduced into the stator chamber 58 via the inlet openings 24 and exhausted through the outlet openings 26. Normally as in the operation of the device as a motor, such gas is introduced at a relatively high pressure and exhausted at a relatively low pressure. Also as previously explained, the source of such gaseous medium may be varied as may the operational mode of the device; i.e., the gear 34 may be driven so as to cause the rotor to rotate, thus causing the vanes to assume a similar path such that air or other gaseous material may be drawn into the stator chamber 58 and forced outwardly from the openings 26 at a higher pressure thus acting as a compressor. Similar adjustments may be made so that the device may operate as a pump.

Figure 5:
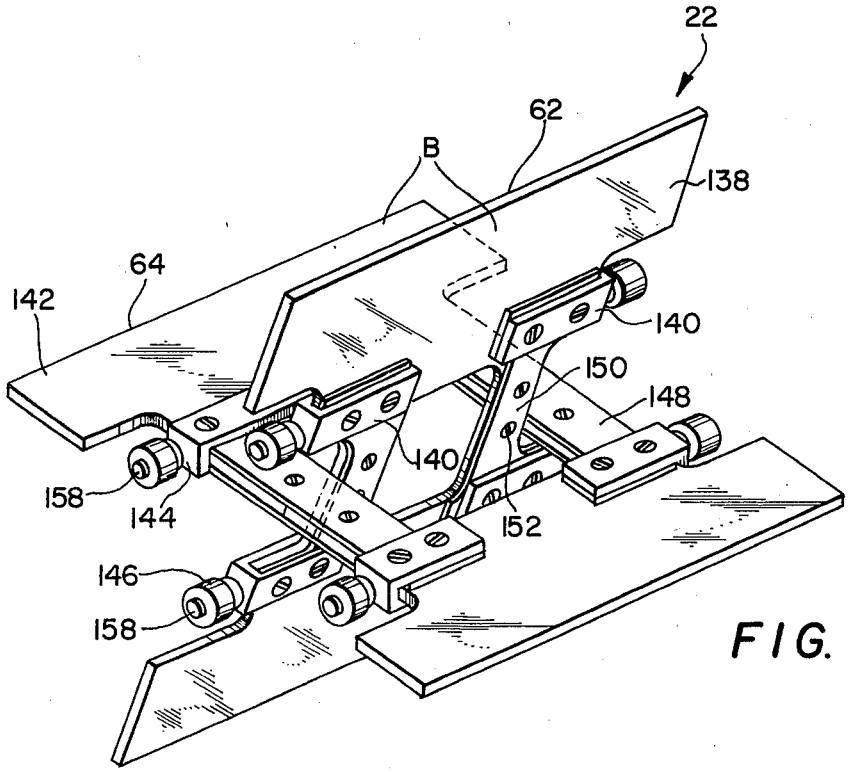
FIG. 5 is a perspective view of the double vane construction depicted in a position corresponding to that shown in FIGS. 2 and 3.

Turning now to FIG. 5 of the drawings in particular, the construction of the power or vane assembly 22 is best shown. The vane assembly 22 includes a first slidable vane element 62 and a second slidable vane element 64. The vane element 62 includes two similarly shaped sections 138 which are joined together by bifurcated yoke portions 144. Each of the yokes includes a roller 146 positioned at its outer extremity. Alternatively, a sliding shoe may be utilized in place of the rollers 146 and for a purpose which will be hereinafter evident. The term roller thus includes sliding shoes.

Each of the vane elements 62 and 64 includes blade-like portions B which extend laterally to both sides and which are adapted as previously indicated to extend into the slots 104 of the end caps 92 provided for such purpose. Overall the construction of the vane assembly 22 is such that portions thereof may be readily removed from each other for ease in assembly and disassembly as for periodic replacement thereof. In that regard, it may be seen that the similarly shaped portions of the elements 62 and 64 are joined together by essentially flat plates 148 and 150. These plates 148 and 150 serve as connectors and accordingly join the blades portions thereof together by means of screws 152 or other suitable means. The rollers 146 are free to rotate on shafts 158 which laterally extend from the yokes 140 and 144.

The rollers 146 are adapted to engage inner surface portions 160 of an idling hub or race ring which serves to control; i.e., direct, the path of rotational movement which the vane assembly 22 can assume. The idling hubs 162 are positioned at opposite sides of the housing 12 and are positioned upon a fixed pin shaft 164 inwardly extending into the hollow rotor from the crank 108. A central boss 166 of the hub 162 receives a roller bearing 158 as by press fit or other means and in which the pin shaft 164 is supported. Accordingly, it may be seen that the hub 152 is free to idle about pin shaft 164 while supported by the bearings 168 and is positioned entirely within the hollow confines of the rotor 20.

Figure 11:
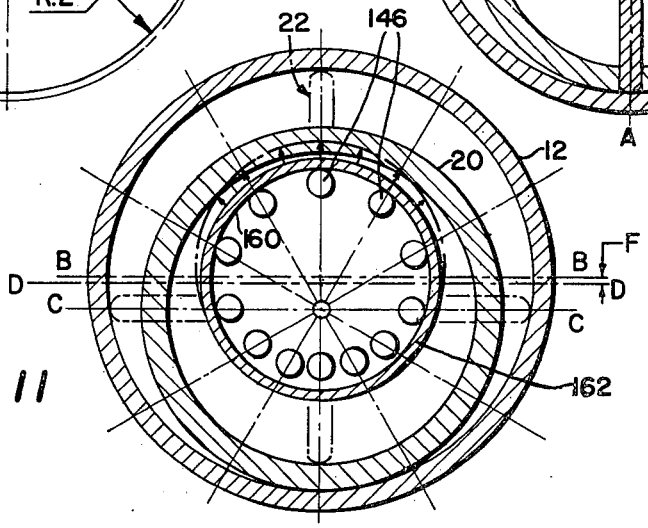
FIG. 11 is a diagrammatic view illustrating the further reduction of centrifugal force brought about by the simultaneous support and directional control of the rotational path of the sliding vanes by means of the contact of the rollers attached thereto with the free rotating inner race rings.

Also as may be best seen by simultaneous reference to FIGS. 11 and 2, the centrifugal force imparted to the separate vane segments 62 and 64 and that portion of the stator chamber 58 between the inlet and outlet openings 26 and 28 respectively, forces the rollers 146 into contact with the interior portions of the idling hubs 152 such that the desired amount of clearance between the blades and the interior surface of the stator chamber is achieved. This clearance will also as previously explained be along both circular paths. In the lower portion of the chamber between the inlet and outlet openings, the rollers 144 are out of contact with the idling hub 162 such that the individual slidable vanes 62 and 64 in such position are free to slide upwardly and accordingly similarly out of frictional contact with such lower portion of the stator housing. Inasmuch as the distance between the rollers 146 and the distal blade B on which a particular roller is supported is always the same, the position of the hubs 162 is chosen so that the desired clearance (about 0.005 inches) between the blades B and the stator chamber 58 is brought about in the power stroke of the vane assembly in the upper stator section between the inlet and outlet ports. In this regard, the center line (D—D) of the hubs 162 as seen in FIG. 11 is displaced a distance F below the center line B—B of the stator. The rotor and ring are schematically illustrated with one position of the vanes indicated at 22 in broken lines. This relatively small displacement also results in the rollers 146 being forced out of contact with the hubs 162 during the lower nonpower stroke of the vane assembly (again noting the fixed distance between any particular roller 146 and its associated blade B) also as shown in FIG. 11. Thus, the centrifugal force which otherwise would be translated into frictional force if blade/stator contact were present as in the FIG. 10 embodiment is transferred to the idling hubs 162 via the rollers or slidable shoes 146. Also by reason of the free idling nature of the hubs 162 and rollers 146, there is little likelihood of their mutual coaction causing uneven wear patterns on the hub surfaces 160.

It is accordingly desirable that the position of the vane assembly 22 can be adjusted relative to the stator housing such that such desirable above-described rotational movement can take place in the intended controlled manner. Such adjustment is brought about by an adjusting assembly including two flat surfaces 174 machined on the one end portion surface of each of the rotor shafts 110 in a location which extends outwardly of the bearing caps 112 and 118. As was previously explained, the rotor shaft 110, the crank 108, and the crank pin 164 are essentially one piece construction and accordingly rotation of the shaft 110 with respect to the bearing covers 112 or 118 will serve to support and to position the idler hubs 162 with respect to the stator chamber 58. An adjustment disc 176 having a central rectangular or square opening (not shown) and adapted to engage the flat 174 is supported on shaft 110 and positioned on the outside surface of the bearing covers 112 or 118 by means of bolts 178 extending through arcuate slots (also not shown) and then into wall of the particular bearing cover. Accordingly, rotation of the adjustment disc can be utilized to position the hubs 162 individually at a top dead center position or other desirable intended position after which the bolts 178 are tightened to insure that such position is maintained. In this regard it should be pointed out that each of the idler hubs 162 should be positioned with regard to the stator chamber at an equal height such that no undesirable tortional force is imparted to the opposed rollers 146 of a particular vane element 62 or 64.

The prevention of the centrifugal force by reason of the incorporation of the idler drums or race rings in the aforementioned way so as to control rotational movement of the vane assembly 22 with respect to the rotor is best shown in FIG. 11 wherein the outlined area represents the total of frictional force. It may be seen from a comparison of FIGS. 10 and 11 that such centrifugal force is essentially the same in both embodiments but in the FIG. 11 system wherein the novel stator housing is additionally provided with the innovative idler hubs 162 so that the centrifugal force is transferred by the rollers 146 to the interior surface 160 of the idling hubs. Thus a sliding friction of the vanes against the stator housing as in FIG. 10 is transferred to a rolling resistance taken up by the ball bearings 168 in FIG. 11. Accordingly, the present motor construction can even be operated at significantly reduced friction levels or at significantly greater speeds or a combination of both when such idler hub system is utilized.

It should be pointed out that with regard to high speed operation of the rotor; i.e., over 2000 to 6000 RPM, and dependent on the I.D. of the stator housing, sealing-elements between the interior of the stator and the vanes may not be necessary because the frictional sealing contact may result in substantially much higher energy losses than the insignificant pressure loss of the driving medium at such speeds.

It should also be pointed out that the desirable inside configuration of the stator housing formed as herein described by cutting shell the halves 14, 16 may be otherwise achieved as by molding about a core machined in the desired form, the essential feature being the resultant desirable inside configuration described.

What is claimed is:

1. A rotary vane apparatus having a housing including a stator chamber in which a rotor including at least a pair of double sliding vanes is adapted to rotate in said chamber wherein the rotor axis is eccentrically displaced in said chamber and said vanes oscillate during rotation, the improvement comprising:

a pair of opposed substantially semi-cylindrical shells each having a portion of a true circular internal surface compositely forming said stator chamber wherein a diametrical chordal segment of said shells has been removed so as to form said chamber in an overall noncircular configuration but having true circular portions;

means restraining the vanes against centrifugal force imparted to said vanes, said means including;

a pair of circular race rings having opposed open ends disposed within said rotor at opposite sides thereof;

crank means carrying said race rings for rotation; and said vanes having guide means at opposite sides thereof contacting said race rings;

whereby the oscillatory motion of said vanes is limited.

2. The structure set forth in claim 1 wherein said guide means include rollers.

3. The structure set forth in claim 1 wherein said rotor includes a plurality of segments spaced to accommodate adjacent vane portions therebetween.

* * * * *